US011155450B2

(12) United States Patent
Fan et al.

(10) Patent No.: US 11,155,450 B2
(45) Date of Patent: Oct. 26, 2021

(54) VEHICLE, WINCH FOR VEHICLE AND WARNING CONTROL DEVICE FOR WINCH OF VEHICLE

(71) Applicant: T-MAX (HANGZHOU) TECHNOLOGY CO., LTD., Hangzhou (CN)

(72) Inventors: Xing Fan, Hangzhou (CN); Hangfei Yu, Hangzhou (CN)

(73) Assignee: T-MAX (HANGZHOU) TECHNOLOGY CO., LTD., Zhejiang (CN)

( * ) Notice: Subject to any disclaimer, the term of this patent is extended or adjusted under 35 U.S.C. 154(b) by 107 days.

(21) Appl. No.: 16/742,632

(22) Filed: Jan. 14, 2020

(65) Prior Publication Data

US 2020/0299116 A1 Sep. 24, 2020

(30) Foreign Application Priority Data

Mar. 22, 2019 (CN) ..... 201910224128.9

(51) Int. Cl.
*B66D 1/48* (2006.01)
*B66D 1/12* (2006.01)

(52) U.S. Cl.
CPC ..... *B66D 1/485* (2013.01); *B66D 1/12* (2013.01); *B66D 2700/0141* (2013.01)

(58) Field of Classification Search
CPC ... B66D 1/40; B66D 1/46; B66D 1/48; B66D 1/485; B66D 1/58; B66D 2700/0125; B66D 2700/0141
See application file for complete search history.

(56) References Cited

U.S. PATENT DOCUMENTS 4,103,872 A * 8/1978 Hirasuka ..... B66D 1/58 254/356
2018/0118530 A1* 5/2018 August ..... H01P 1/005
2019/0292026 A1* 9/2019 Felps ..... B66D 1/485

* cited by examiner

*Primary Examiner* — Michael E Gallion
(74) *Attorney, Agent, or Firm* — Perkins Coie LLP

(57) ABSTRACT

The present disclosure discloses a vehicle, a winch for the vehicle, and a warning control device for the winch of the vehicle. The warning control device includes: a warning component; and a warning control board, including: a load detector, connected to the motor through a current sensor, and configured to detect load condition of the motor by collecting measured working current of the motor; a processor, connected to the load detector and the warning controller respectively, and configured to output a warning control signal to the warning controller according to the load condition of the motor; and a warning controller, connected to the warning component and the processor respectively, and configured to receive the warning control signal and to control the warning component to produce a warning based on the warning control signal.

20 Claims, 7 Drawing Sheets

VEHICLE, WINCH FOR VEHICLE AND WARNING CONTROL DEVICE FOR WINCH OF VEHICLE

CROSS-REFERENCE TO RELATED APPLICATIONS

This application claims priority to and benefits of Chinese Patent Application Serial No. 201910224128.9, filed with the National Intellectual Property Administration of People's Republic of China (PRC) on Mar. 22, 2019, the entire content of which is incorporated herein by reference.

TECHNICAL FIELD

The present disclosure relates to the field of traction equipment technologies, and more particularly to a vehicle, a winch for a vehicle, and a warning control device for a winch of a vehicle.

BACKGROUND

A winch is often used in an off-road vehicle, an agricultural vehicle, a yacht, a firefighting rescue vehicle, a road obstacle clearing truck and other special vehicles mainly for automobile rescue, loading and unloading, or hoisting goods. The winch can be used as a self-protection and traction device, typically in a vehicle or in a ship, which may perform self-rescue and rescue in harsh environments such as snow, marshes, deserts, beaches, and muddy mountain roads, and may perform work such as clearing obstacles, hauling items, or installing things under other conditions.

SUMMARY

Embodiments of the present disclosure provide a warning control device for a winch of a vehicle. In some embodiments, the winch includes a motor configured to drive the winch. In some embodiments, the warning control device includes a warning component and a warning control board. In some embodiments, the warning control board includes a load detector, a processor, and a warning controller. The load detector is connected to the motor through a current sensor, and is configured to detect a load condition of the motor based on the measured working current of the motor, e.g., by acquiring the working current measurements of the motor. The processor is connected to the load detector and the warning controller, respectively, and is configured to output a warning control signal to the warning controller according to the load condition of the motor detected by the load detector. The warning controller is connected to the warning component and the processor, respectively, and is configured to receive the warning control signal and to control the warning component to produce a warning based on the warning control signal.

Embodiments of the present disclosure provide a winch for a vehicle, including the above warning control device for the winch of the vehicle.

Embodiments of the present disclosure further provide a vehicle including the above winch for the vehicle.

DETAILED DESCRIPTION

Reference will be made in detail below to the embodiments of the present disclosure, examples of which are illustrated in the accompanying drawings, in which the same or similar numbers represent the same or similar elements or the elements with the same or similar function. The embodiments described herein are exemplary and for the purpose of describing the present disclosure, and should not be construed to limit the present disclosure.

Most of winches in the related art are generally controlled by manual means. In actual use, not only is the manual operation inconvenient, but also a specific operation condition of the winch is not known; thus, it is difficult to meet user needs. Therefore, embodiments of the present disclosure provide a vehicle, a winch for a vehicle, and a warning control device for a winch of a vehicle.

Description will be made below to a vehicle, a winch for a vehicle, and a warning control device for a winch of a vehicle provided in embodiments of the present disclosure with reference to the accompanying drawings.

As illustrated in FIG. 1 through FIG. 8, in embodiments of the present disclosure, a winch 100 for a vehicle may be a direct current (DC) electronic winch, and the winch 100 for the vehicle includes a motor M configured to drive the winch. The motor M may be a permanent magnet motor and may also be a universal motor.

Figure 2:
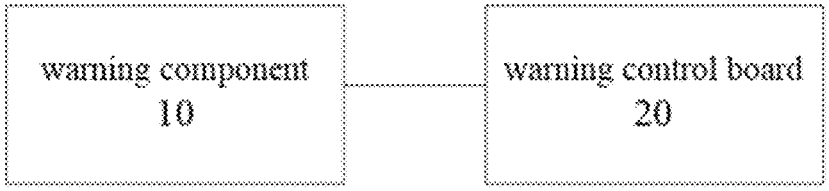
FIG. 2 is a block diagram illustrating a warning control device for a winch of a vehicle according to an embodiment of the present disclosure.

As illustrated in FIG. 2, the warning control device for the winch of the vehicle includes a warning component 10 and a warning control board 20. The warning component 10 is connected to the warning control board 20, and the warning control board 20 is configured to control the warning component 10 to produce a warning.

Figure 3:
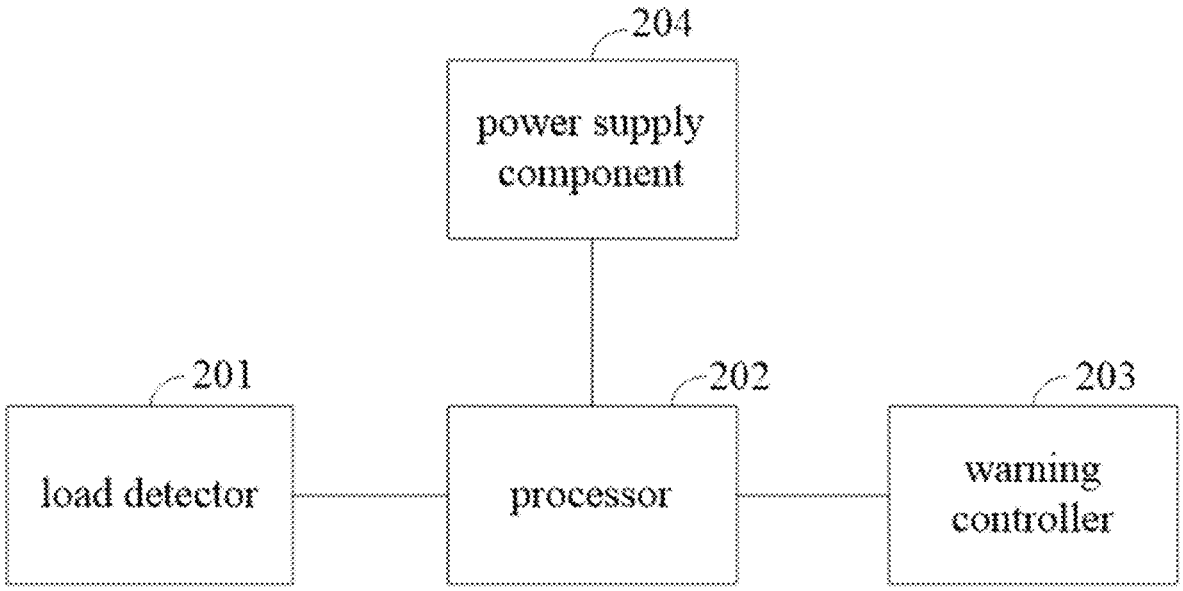
FIG. 3 is a block diagram illustrating a warning control board according to an embodiment of the present disclosure.

As illustrated in FIG. 3, the warning control board 20 has a load detector 201, a processor 202, and a warning controller 203 disposed thereto. The load detector 201 is connected to the motor M through a current sensor, and it is configured to detect a load condition of the motor M based on the measured working current, e.g., by collecting working current measurements of the motor M. The processor 202 is connected to the load detector 201 and the warning controller 203 respectively, and is configured to output a warning control signal to the warning controller 203 according to the load condition of the motor M. The warning controller 203 is connected to the warning component 10 and the processor 202 respectively, and is configured to receive the warning control signal and to control the warning component 10 to produce a warning based on the received warning control signal. The current sensor may be a Hall current sensor illustrated in FIG. 1, and may also be any other current sensor. The load detector 201 detects the load condition of the motor M by collecting the measured working current of the motor M. The Hall current sensor has high accuracy and reliability, is less affected by temperature changes, and is not affected by winch heating or wire heating during the use of the winch. The warning component 10 may include a display component and/or a buzzer component, and the display component and the buzzer component are connected with the warning controller 203 respectively. In some embodiments, the display component can produce a light warning according to the received warning control signal, and the buzzer component can produce a sound warning according to the received warning control signal.

In other words, in embodiments of the present disclosure, the load detector 201 collects the measured working current of the motor M to detect the real-time load condition of the winch, such that different warnings may be implemented according to the real-time load condition of the winch, and the real-time load condition of the winch may be obtained timely during actual use of the winch, thereby avoiding some extreme situations such as winch overload operation.

The winch 100 is driven by the motor M, and the motor M may be the permanent magnet motor or the universal motor. Both current curves of the permanent magnet motor and the universal motor are proportional to load torque. In other words, as long as the load torque is determined, there is a working current value needed by a motor with a same model parameter corresponding to the load torque. The present disclosure may apply this principle to detect the real-time load condition of the winch, that is, the real-time load of the motor, such that different warnings are implemented based on different loads, to inform the user of the real-time load condition of the winch during use, and to avoid some extreme situations.

Figure 4:
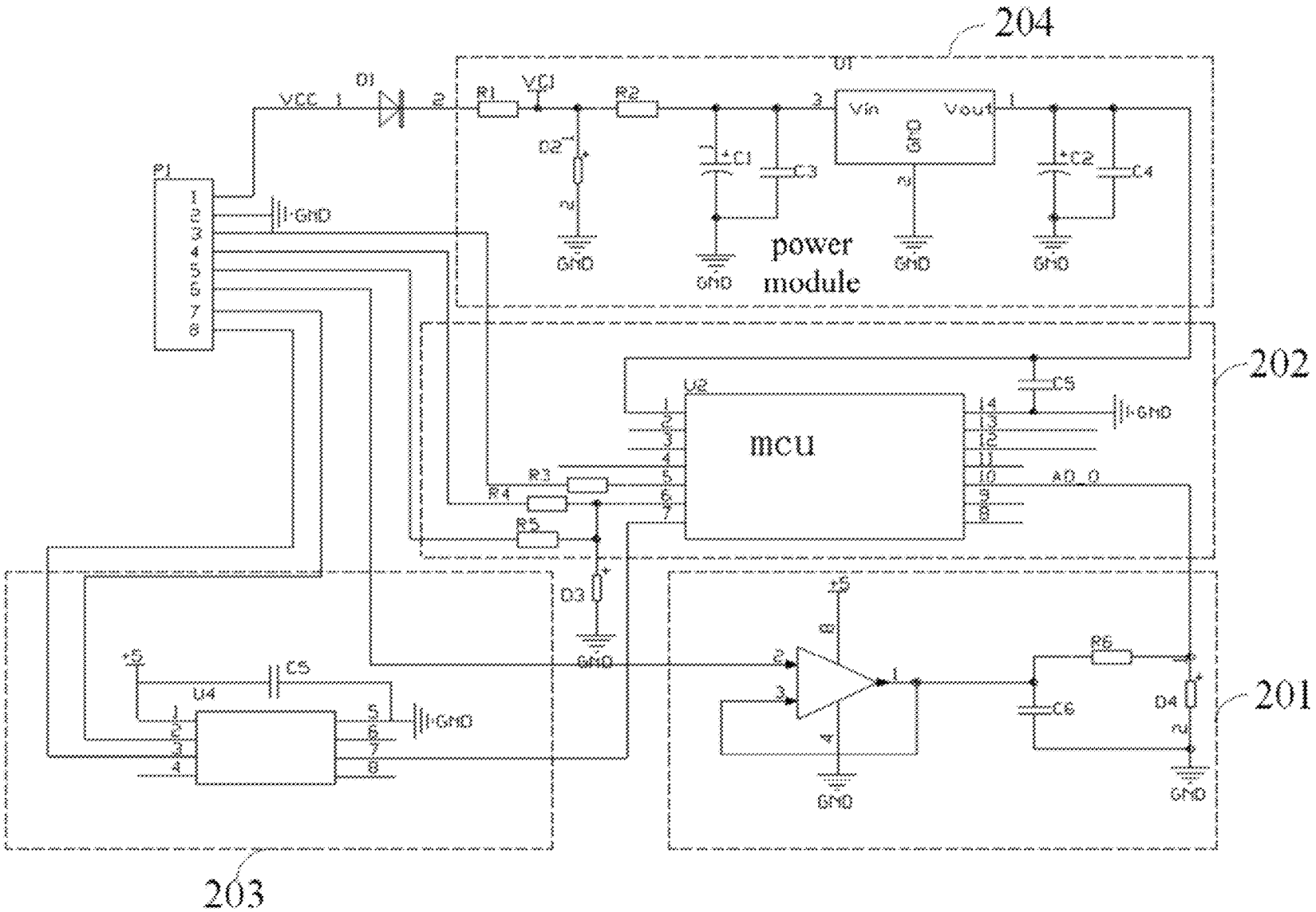
FIG. 4 is a circuit schematic diagram illustrating a warning control board according to an embodiment of the present disclosure.
Figure 5:
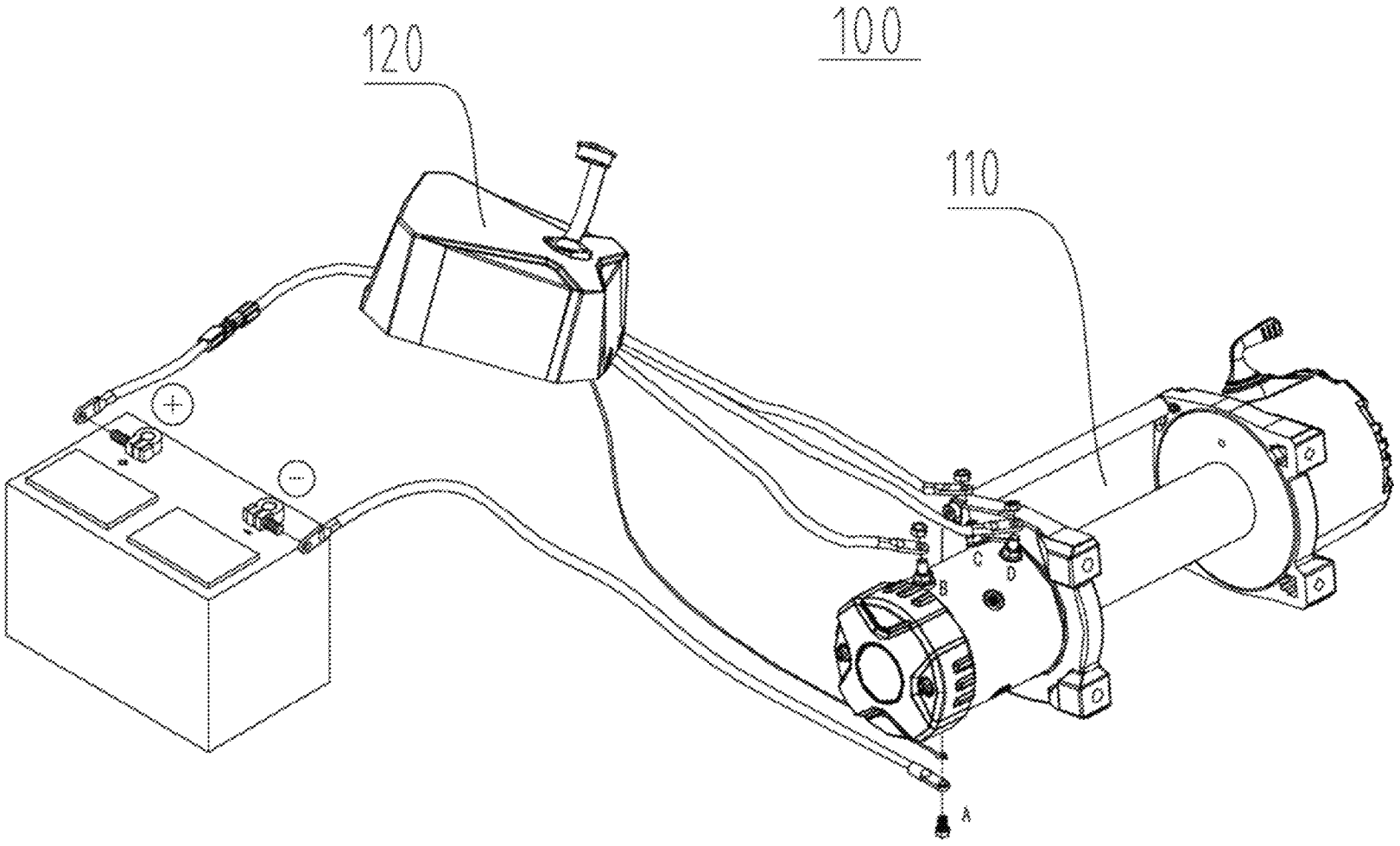
FIG. 5 is a wiring schematic diagram illustrating a winch for a vehicle according to an embodiment of the present disclosure.

Further, as illustrated in FIG. 4, the load detector 201 may include an operational amplifier. The operational amplifier amplifies a voltage signal at an output end of the current sensor and inputs the amplified voltage signal to the processor 202. The processor 202 is illustrated in FIG. 4. A pre-designed single chip computer U2 is selected as a processor, the voltage signal output by the load detector 201 is collected by an AD (Analog-to-Digital) sampling signal, then a current value currently passing through the current sensor is obtained by calculation, and finally an instruction is sent to the warning controller 203.

Further, the display component in the warning component 10 may be an LED (light-emitting diode) display light bar. The warning controller 203 serves as a three-color control part of the LED display bar. After the instruction sent by the processor 202 is received, the warning controller 203 controls three primary colors in the LED display light bar to form different colors, and the current load condition of the winch is indicated by using different numbers of lighted LED lights and a display color of each lighted light.

According to an embodiment of the present disclosure, as illustrated in FIG. 3 and FIG. 4, the warning control board 20 also has a power supply component 204 disposed thereto. The power supply component 204 converts voltage of a storage battery in the vehicle to supply power for the warning control board 20.

The voltage of the storage battery in the vehicle may be 12.8V, and the power supply component 204 converts the voltage of the storage battery from 12.8V to 5V to supply power for the warning control board 20.

According to an embodiment of the present disclosure, in conjunction with illustrations in FIG. 1, FIG. 5, FIG. 6, FIG. 7, and FIG. 8, the display component in the warning component 10 includes a first display light bar 101 and/or a second display light bar 102. The first display light bar 101 is disposed to a winch body 110 of the winch 100, the second display light bar 102 is disposed to an operating handle 120 of the winch 100, and the first display light bar 101 and the second display light bar 102 are lighted under control of the warning controller 203.

In some embodiments, each of the first display light bar 101 and the second display light bar 102 includes a plurality of LED lights. For example, a number of the LED lights in the first display light bar 101 may be the same as a number of the LED lights in the second display light bar 102, and the display manner of the LED lights in the first display light bar 101 may be the same as the display manner of the LED lights in the second display light bar 102. In this way, the warning controller 203 controls the first display light bar 101 and the second display light bar 102 to be lighted at the same time and in the same manner according to the received warning control signal.

The warning controller 203 controls a number of lighted LED lights and a display color of each lighted light according to the received warning control signal. For example, the three primary colors of the LED lights in the first display light bar 101 and in the second display light bar 102 may be controlled to form different colors, and the current load condition of the winch is indicated by different numbers of the lighted LED lights and the display color of each lighted light.

In an embodiment of the present disclosure, the number of lighted LED lights and the display color of each lighted LED light may appear according to the following Table 1 when the first display light bar 101 and/or the second display light bar 102 correspond/corresponds to different winch loads.

TABLE 1

| | Different loads (Lbs.) corresponding to different modes of the winch | | | | | Different lights | | | | | | | | | |
|---|---|---|---|---|---|---|---|---|---|---|---|---|---|---|---|
| Serial number | Design ratio | Model 1 | Model 2 | Model 3 | Model 4 | Light one | Light two | Light three | Light four | Light five | Light six | Light seven | Light eight | Light nine | Light ten |
| 1 | | Power on no load | Power on no load | Power on no load | Power on no load | blue | blue | blue | blue | blue | blue | blue | blue | blue | blue |
| 2 | | | | | | green | green | green | green | green | green | green | green | green | green |
| 3 | 10% | 1000 | 1200 | 1550 | 1750 | green | | | | | | | | | |
| 4 | 20% | 2000 | 2400 | 3100 | 3500 | green | green | | | | | | | | |
| 5 | 30% | 3000 | 3600 | 4650 | 5250 | green | green | green | | | | | | | |

TABLE 1-continued

| | Different loads (Lbs.) corresponding to different modes of the winch | | | | | Different lights | | | | | | | | | |
|---|---|---|---|---|---|---|---|---|---|---|---|---|---|---|---|
| Serial number | Design ratio | Model 1 | Model 2 | Model 3 | Model 4 | Light one | Light two | Light three | Light four | Light five | Light six | Light seven | Light eight | Light nine | Light ten |
| 6 | 40% | 4000 | 4800 | 6200 | 7000 | yellow | yellow | yellow | yellow | | | | | | |
| 7 | 50% | 5000 | 6000 | 7750 | 8750 | yellow | yellow | yellow | yellow | yellow | | | | | |
| 8 | 60% | 6000 | 7200 | 9300 | 10500 | yellow | yellow | yellow | yellow | yellow | yellow | | | | |
| 9 | 70% | 7000 | 8400 | 10850 | 12250 | red | red | red | red | red | red | red | | | |
| 10 | 80% | 8000 | 9600 | 12400 | 14000 | The first eight lights are red and flashing slowly (A flashing interval is about 0.3 seconds) | | | | | | | | | |
| 11 | 90% | 9000 | 10800 | 13950 | 15750 | The first nine lights are red and flashing with a medium speed (A flashing interval is about 0.2 seconds) | | | | | | | | | |
| 12 | 100% | 10000 | 12000 | 15500 | 17500 | All the lights are red and flashing quickly (A flashing interval is about 0.05 seconds) | | | | | | | | | |

The first display light bar 101 includes ten LED lights, and the second display light bar 102 includes three LED lights.

Figure 6:
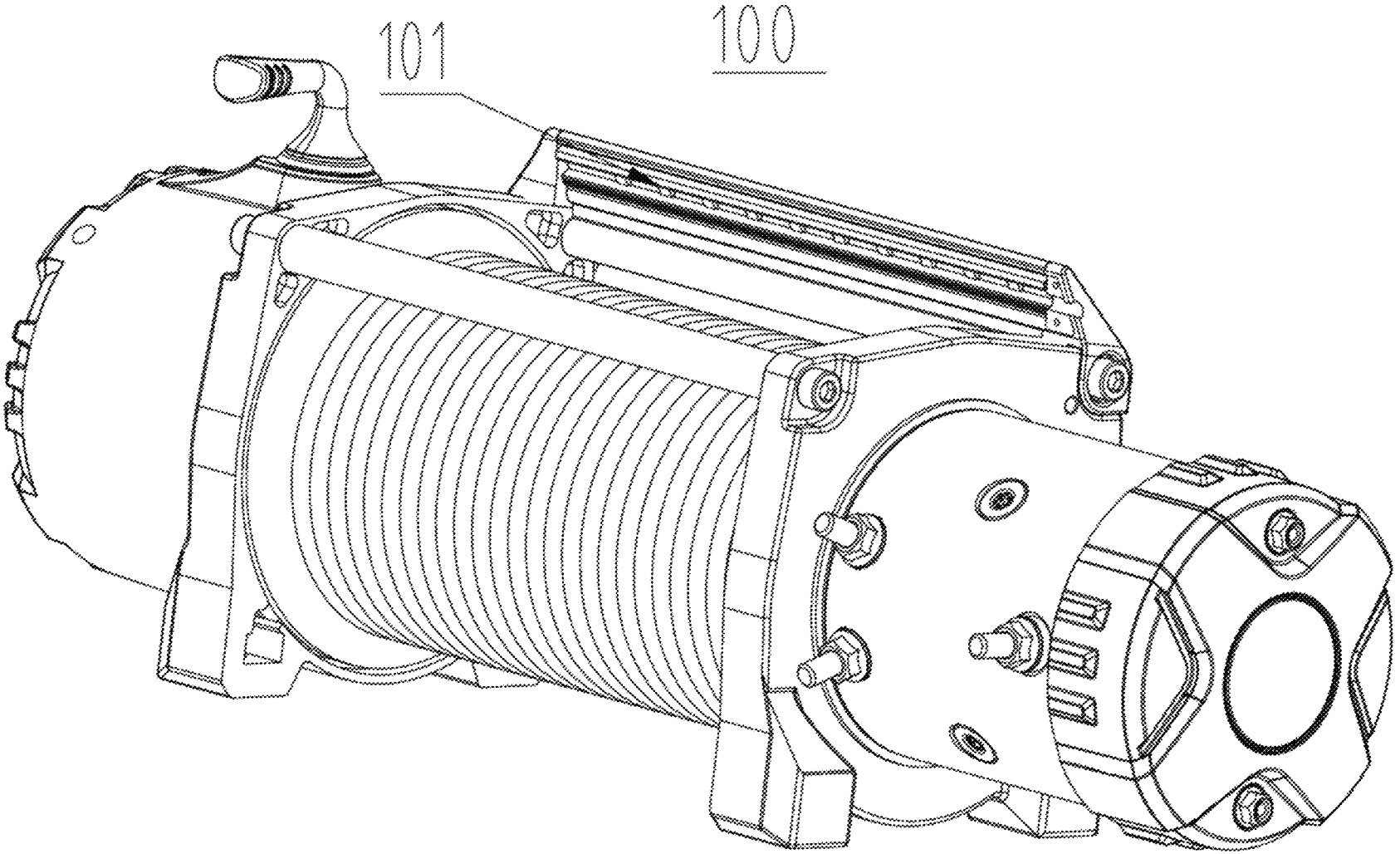
FIG. 6 is a schematic diagram illustrating a first display light bar coupled to a winch body according to an embodiment of the present disclosure.

According to an embodiment of the present disclosure, as illustrated in FIG. 6, the first display light bar 101 may be disposed to the winch body 110 in a built-in way.

Figure 7:
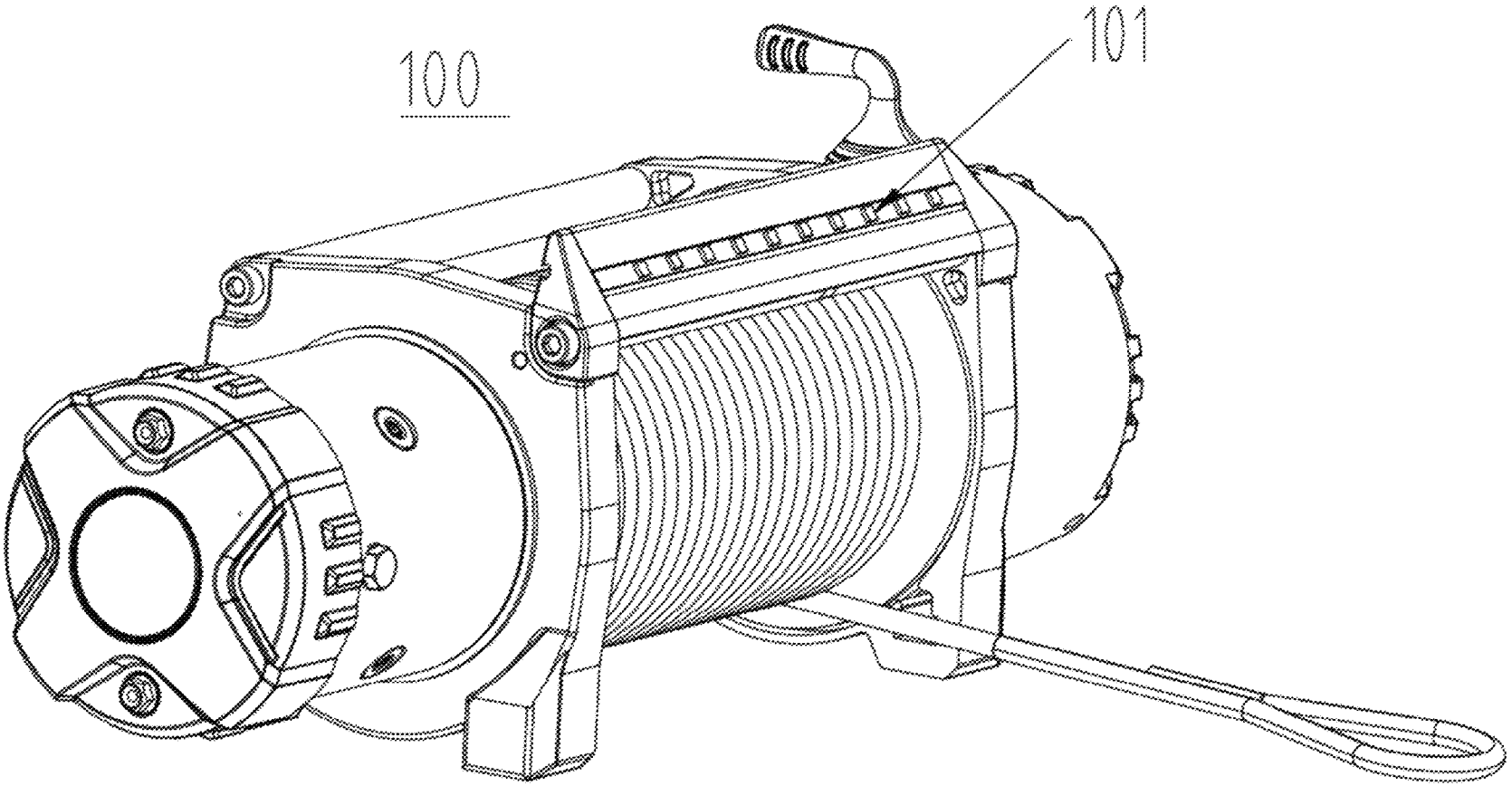
FIG. 7 is a schematic diagram illustrating a first display light bar coupled to a winch body according to another embodiment of the present disclosure.
Figure 8:
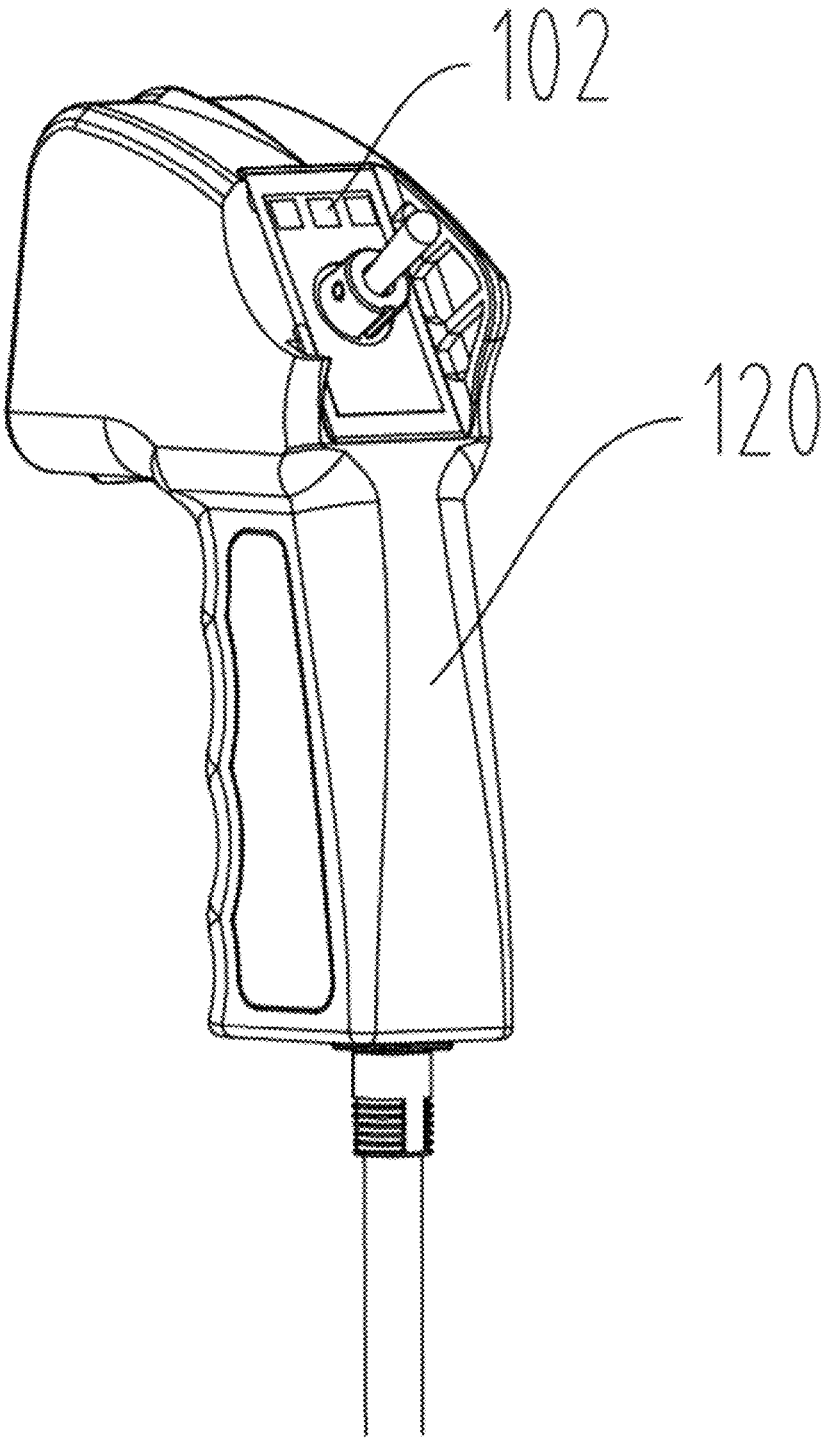
FIG. 8 is a schematic diagram illustrating a second display light bar coupled to an operating handle according to an embodiment of the present disclosure.

According to another embodiment of the present disclosure, as illustrated in FIG. 7, the first display light bar 101 may also be disposed to the winch body 110 in an exposed way.

Figure 1:
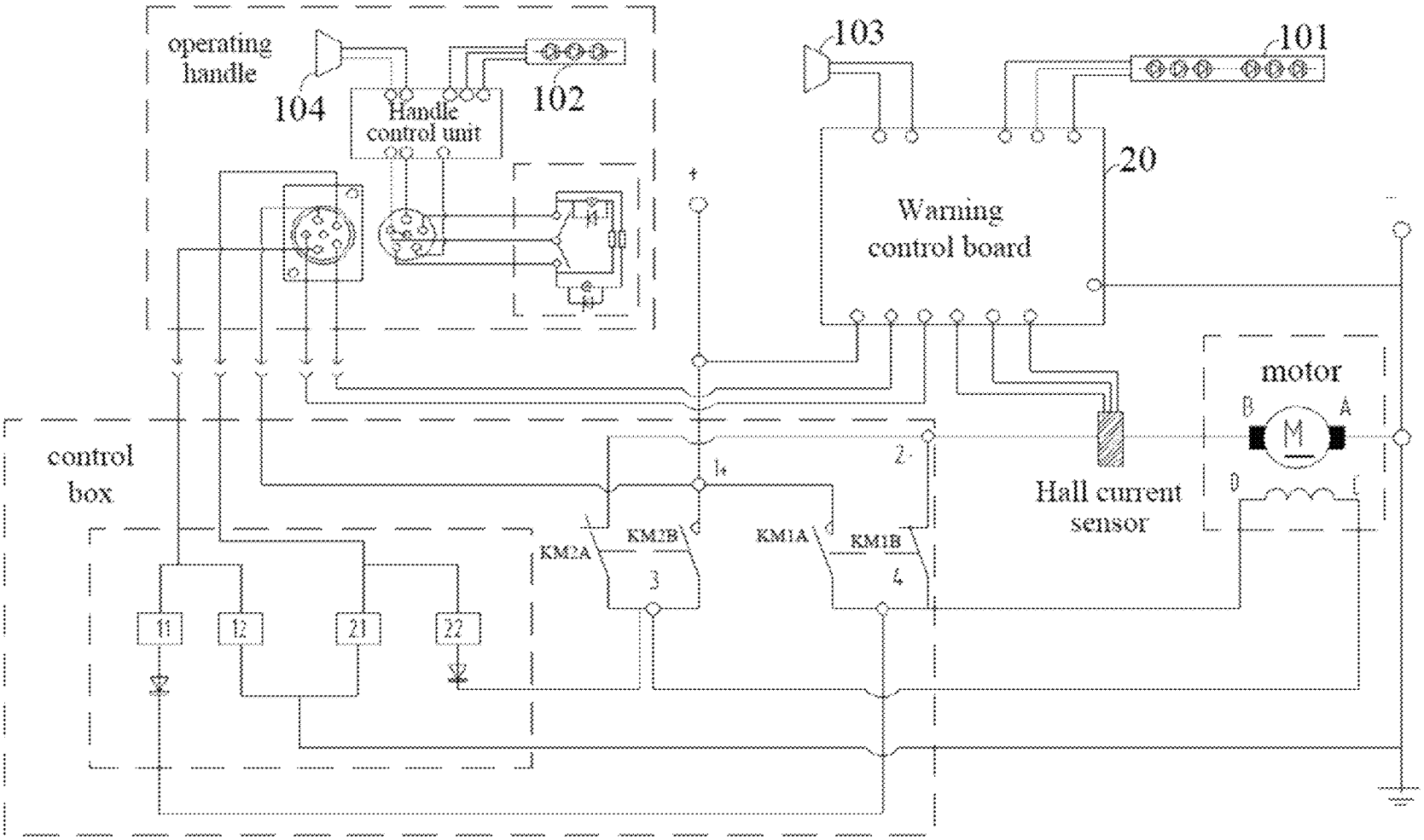
FIG. 1 is a circuit principle diagram illustrating a winch for a vehicle according to an embodiment of the present disclosure.

According to an embodiment of the present disclosure, as illustrated in FIG. 1, the buzzer component in the warning component 10 may include a first buzzer 103 and/or a second buzzer 104. The first buzzer 103 is disposed to the winch body 110 of the winch 100, the second buzzer is disposed to the operating handle 120 of the winch 100, and the first buzzer 103 and the second buzzer 104 can produce a sound warning under the control of the warning controller 203. The warning controller 203 controls a volume of the first buzzer 103 and/or a volume of the second buzzer 104 according to the received warning control signal.

The first buzzer 103 may be disposed to the winch body 110 in a built-in way or an exposed way.

With the warning control device for the winch of the vehicle provided according to embodiments of the present disclosure, the load condition of the motor is detected by the load detector, the processor may output the warning control signal to the warning controller according to the real-time load condition of the motor, and the warning controller controls the warning component to produce the warning. Therefore, the warning control device for the winch of the vehicle according to the present disclosure may implement different warnings based on different load conditions of the winch, and may obtain the real-time load condition of the winch timely during the actual use of the winch. In this way, some extreme situations, such as winch overload operation, may be avoided; the winch may be ensured to work safely, reliably, and stably; a service life of the winch is improved; and use needs are fully met.

Further, the present disclosure provides a winch for a vehicle, including the above warning control device for the winch of the vehicle.

With the winch for the vehicle provided according to the present disclosure, through the above warning control device for the winch of the vehicle, different warnings may be implemented based on different load conditions of the winch, and the real-time load condition of the winch may be obtained timely during actual use of the winch. In this way, some extreme situations, such as winch overload operation, may be avoided; the winch may be ensured to work safely, reliably, and stably; the service life of the winch is improved; and use needs are fully met.

In addition, the present disclosure further provides a vehicle including the above winch for the vehicle.

With the vehicle provided in the present disclosure, different warnings may be implemented based on different load conditions of the winch, and the real-time load condition of the winch may be obtained timely during actual use of the winch. In this way, some extreme situations, such as winch overload operation, may be avoided; the winch may be ensured to work safely, reliably, and stably; the service life of the winch is improved; and use needs are fully met.

In the description of the present disclosure, it is to be understood that terms such as "center," "longitudinal," "lateral," "length," "width," "thickness," "over," "below," "front," "back," "left," "right," "vertical," "horizontal," "top," "bottom," "in," "out," "clockwise," "anti-clockwise," "axial," "radial," and "circumference" refer to the directions or location relations which are the directions or location relations shown in the drawings. These terms are used to describe the present disclosure in a simple way and are not intended to indicate or imply that the device or the elements are disposed to locate at the specific directions or are structured and performed in the specific directions, and they should not be understood to limit the present disclosure.

In addition, terms such as "first" and "second" are used herein for purposes of description and are not intended to indicate or imply relative importance or implicitly indicate the number of indicated technical features. Furthermore, the feature defined with "first" and "second" may comprise one or more of this feature distinctly or implicitly. In the description of the present disclosure, "a plurality of" means two or more, unless specified otherwise.

In the present disclosure, unless specified or limited otherwise, the terms "mounted," "connected," "coupled" and "fixed" are understood broadly, such as fixed, detachable mountings, connections and couplings or integrated, and can be mechanical or electrical mountings, connections and couplings, and also can be direct and via media indirect mountings, connections, and couplings, and further can be inner mountings, connections and couplings of two components or interaction relations between two components, which can be understood by those skilled in the art according to the detailed embodiment of the present disclosure.

In the present disclosure, unless specified or limited otherwise, the first characteristic is "on" or "under" the second characteristic refers to the first characteristic and the second characteristic can be direct or via media indirect mountings, connections, and couplings. And, the first characteristic is "on", "above", "over" the second characteristic may refer to the first characteristic is right over the second characteristic or is diagonal above the second characteristic, or just refer to the horizontal height of the first characteristic is higher than the horizontal height of the second characteristic. The first characteristic is "below" or "under" the second characteristic may refer to the first characteristic is right over the second characteristic or is diagonal under the second characteristic, or just refer to the horizontal height of the first characteristic is lower than the horizontal height of the second characteristic.

In the description of the present disclosure, reference throughout this specification to "an embodiment," "some embodiments," "an example," "a specific example," or "some examples," means that a particular feature, structure, material, or characteristic described in connection with the embodiment or example is included in at least one embodiment or example of the present disclosure. The appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, without a contradiction, the different embodiments or examples and the features of the different embodiments or examples can be combined by those skilled in the art.

Although embodiments of the present disclosure have been shown and described above, it should be understood that the above embodiments are exemplary and cannot be understood to limit the present disclosure. Those skilled in the art can make changes, alternatives, and modifications in the embodiments within scope of the present disclosure.

It is intended that the specification, together with the drawings, be considered exemplary only, where exemplary means an example. As used herein, the singular forms "a," "an," and "the" are intended to include the plural forms as well, unless the context clearly indicates otherwise. Additionally, the use of "or" is intended to include "and/or," unless the context clearly indicates otherwise.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described, and other implementations, enhancements, and variations can be made based on what is described and illustrated in this patent document.

What is claimed is:

1. A warning control device for a winch of a vehicle that is driven by a motor, the warning control device comprising:

a warning component; and a warning control board, comprising a load detector, a processor, and a warning controller, wherein:

the load detector is connected to the motor through a current sensor, and is configured to detect a load condition of the motor by collecting working current measurements of the motor;

the processor is connected to the load detector and the warning controller, respectively, and is configured to output a warning control signal to the warning controller according to the load condition of the motor detected by the load detector; and the warning controller is connected to the warning component and the processor, respectively, and is configured to receive the warning control signal and to control the warning component to produce a warning based on the warning control signal.

2. The warning control device according to claim 1, wherein the current sensor is a Hall current sensor.

3. The warning control device according to claim 1, wherein the warning component comprises one or both of a display component and a buzzer component, wherein the one or both of the display component and the buzzer component is connected with the warning controller.

4. The warning control device according to claim 3, wherein, the display component comprises a first display light bar and/or a second display light bar, wherein, the first display light bar is coupled to a winch body of the winch, the second display light bar is coupled to an operating handle of the winch, and the first display light bar and/or the second display light bar are lighted under control of the warning controller; and/or the buzzer component comprises a first buzzer and/or a second buzzer, wherein, the first buzzer is coupled to the winch body, the second buzzer is coupled to the operating handle of the winch, and the first buzzer and/or the second buzzer produce a sound warning under the control of the warning controller.

5. The warning control device according to claim 4, wherein, each of the first display light bar and the second display light bar comprises a plurality of light-emitting diode (LED) lights, and the warning controller is configured to control a number of lighted LED lights and a display color of each lighted light according to the warning control signal.

6. The warning control device according to claim 4, wherein the warning controller is configured to control a sound size of the first buzzer and/or a sound size of the second buzzer according to the warning control signal.

7. The warning control device according to claim 4, wherein, the first display light bar is coupled to the winch body so as to be built-in the winch body or to be exposed from the winch body, and/or the first buzzer is coupled to the winch body so as to be built-in the winch body or to be exposed way from the winch body.

8. A winch for a vehicle, comprising:

a motor configured to drive the winch; and a warning control device, wherein, the warning control device comprises:

a warning component; and a warning control board comprising a load detector, a processor, and a warning controller, wherein:

the load detector is connected to the motor through a current sensor, and is configured to detect a load condition of the motor by collecting working current measurements of the motor;

the processor is connected to the load detector and the warning controller, respectively, and is configured to output a warning control signal to the warning controller according to the load condition of the motor detected by the load detector; and the warning controller is connected to the warning component and the processor, respectively, and is configured to receive the warning control signal and to control the warning component to produce a warning based on the warning control signal.

9. The winch according to claim 8, wherein the current sensor is a Hall current sensor.

10. The winch according to claim 8, wherein the warning component comprises one or both of a display component and a buzzer component, wherein the one or both of the display component and the buzzer component is connected with the warning controller.

11. The winch according to claim 10, wherein, the display component comprises a first display light bar and/or a second display light bar, wherein, the first display light bar is coupled to a winch body of the winch, the second display light bar is coupled to an operating handle of the winch, and/or the first display light bar and/or the second display light bar are lighted under control of the warning controller; and/or the buzzer component comprises a first buzzer and/or a second buzzer, wherein, the first buzzer is coupled to the winch body, the second buzzer is coupled to the operating handle of the winch, and the first buzzer and/or the second buzzer produce a sound warning under the control of the warning controller.

12. The winch according to claim 11, wherein, each of the first display light bar and the second display light bar comprises a plurality of light-emitting diode (LED) lights, and the warning controller is configured to control a number of lighted LED lights and a display color of each lighted light according to the warning control signal.

13. The winch according to claim 11, wherein the warning controller is configured to control a sound size of the first buzzer and/or a sound size of the second buzzer according to the warning control signal.

14. The winch according to claim 11, wherein, the first display light bar is coupled to the winch body so as to be built-in the winch body or to be exposed from the winch body, and/or the first buzzer is coupled to the winch body so as to be built-in the winch body or to be exposed from the winch body.

15. A vehicle, comprising a winch, wherein the winch comprises a motor configured to drive the winch and a warning control device, wherein the warning control device comprises:

a warning component; and a warning control board comprising a load detector, a processor, and a warning controller, wherein:

the load detector is connected to the motor through a current sensor, and configured to detect a load condition of the motor by collecting working current measurements of the motor;

the processor is connected to the load detector and the warning controller respectively, and configured to output a warning control signal to the warning controller according to the load condition of the motor detected by the load detector; and the warning controller is connected to the warning component and the processor, respectively, and is configured to receive the warning control signal and to control the warning component to produce a warning based on the warning control signal.

16. The vehicle according to claim 15, wherein the warning component comprises one or both of a display component and a buzzer component, wherein the one or both of the display component and the buzzer component is connected with the warning controller.

17. The vehicle according to claim 15, wherein, the display component comprises a first display light bar and/or a second display light bar, wherein, the first display light bar is coupled to a winch body of the winch, the second display light bar is coupled to an operating handle of the winch, and the first display light bar and/or the second display light bar are lighted under control of the warning controller; and/or the buzzer component comprises a first buzzer and/or a second buzzer, wherein, the first buzzer is coupled to the winch body, the second buzzer is coupled to the operating handle of the winch, and the first buzzer and/or the second buzzer produce a sound warning under the control of the warning controller.

18. The vehicle according to claim 17, wherein, each of the first display light bar and the second display light bar comprises a plurality of light-emitting diode (LED) lights, and the warning controller is configured to control a number of lighted LED lights and a display color of each lighted light according to the warning control signal.

19. The vehicle according to claim 17, wherein the warning controller is configured to control a sound size of the first buzzer and/or a sound size of the second buzzer according to the warning control signal.

20. The vehicle according to claim 17, wherein, the first display light bar is coupled to the winch body so as to be built-in the winch body or an exposed from the winch body, and/or the first buzzer is coupled to the winch body so as to be built-in the winch body or to be exposed from the winch body.

* * * * *